US011378273B2

(12) United States Patent
Smelcer et al.

(10) Patent No.: US 11,378,273 B2
(45) Date of Patent: Jul. 5, 2022

(54) REDUCED RESONANCE BURNER

(71) Applicant: A. O. Smith Corporation, Milwaukee, WI (US)

(72) Inventors: Jimmy Charles Smelcer, Mount Juliet, TN (US); Billy Anthony Batey, Watertown, TN (US); Benjamin Bolton, Milwaukee, WI (US)

(73) Assignee: A. O. Smith Corporation, Milwaukee, WI (US)

( * ) Notice: Subject to any disclaimer, the term of this patent is extended or adjusted under 35 U.S.C. 154(b) by 354 days.

(21) Appl. No.: 15/403,952

(22) Filed: Jan. 11, 2017

(65) Prior Publication Data

US 2018/0195717 A1 Jul. 12, 2018

(51) Int. Cl.
*F23D 14/02* (2006.01)
*F23D 14/14* (2006.01)

(52) U.S. Cl.
CPC ..... *F23D 14/02* (2013.01); *F23D 14/14* (2013.01)

(58) Field of Classification Search
CPC ..... F23D 14/02; F23D 14/14
See application file for complete search history.

(56) References Cited

U.S. PATENT DOCUMENTS 817,751 A * 4/1906 Carroll ..... C10L 10/00 239/544
3,170,504 A * 2/1965 Lanning ..... F23C 99/00 126/92 R
3,647,146 A * 3/1972 Genbauffe ..... F24C 3/08 239/559
3,661,499 A * 5/1972 Krieger ..... F23D 14/14 431/328
4,063,873 A * 12/1977 Naito ..... F23D 14/14 431/328
4,340,357 A * 7/1982 Kito ..... F23D 14/14 431/328
5,645,413 A * 7/1997 Benedek ..... F23C 6/045 122/17.1

(Continued)

FOREIGN PATENT DOCUMENTS

CN 101495806 A 7/2009
DE 4014217 A1 * 11/1990 ..... F23D 14/58

(Continued)

OTHER PUBLICATIONS

International Search Report and Written Opinion for corresponding International Patent Application No. PCT/US2017/060234, dated Feb. 14, 2018, 15 pp (not prior art).

(Continued)

*Primary Examiner* — Michael G Hoang
*Assistant Examiner* — Logan P Jones
(74) *Attorney, Agent, or Firm* — Lucian Wayne Beavers; Patterson Intellectual Property Law, PC

(57) ABSTRACT

A burner apparatus for burning a gas and air mixture may include a burner wall. The burner wall may have a plurality of ridges and a plurality of grooves. Each groove may be defined between adjacent ridges. Each groove may also include a pair of slopes. Each slope may have an area of permeability having openings defined therein from which flames can project. Each ridge may define an area of reduced permeability relative to the areas of permeability of the slopes.

17 Claims, 6 Drawing Sheets

(56) References Cited

U.S. PATENT DOCUMENTS

| | | | | | |
|---|---|---|---|---|---|
| 5,833,450 | A | | 11/1998 | Wunning | |
| 5,989,013 | A | | 11/1999 | Gray | |
| 5,997,285 | A | * | 12/1999 | Carbone | F23D 14/02 431/326 |
| 6,149,424 | A | * | 11/2000 | Marrecau | F23D 14/16 126/92 AC |
| 6,428,312 | B1 | * | 8/2002 | Smelcer | F23D 14/14 431/114 |
| 9,885,476 | B2 | * | 2/2018 | Le Mer | F23D 14/02 |
| 2009/0291402 | A1 | * | 11/2009 | Cho | F23D 14/58 431/278 |
| 2011/0053105 | A1 | | 3/2011 | Kim | |
| 2014/0287371 | A1 | * | 9/2014 | Huang | F23D 14/02 431/354 |
| 2015/0167967 | A1 | * | 6/2015 | Le Mer | F23D 14/02 431/328 |

FOREIGN PATENT DOCUMENTS

| | | | | | |
|---|---|---|---|---|---|
| DE | 4014217 | A1 | | 11/1990 | |
| DE | 202008010227 | U1 | * | 12/2009 | F24C 15/322 |
| DE | 202008010227 | U1 | | 1/2010 | |
| EP | 0950853 | A2 | * | 10/1999 | F23D 14/02 |
| EP | 1337789 | A1 | | 8/2003 | |
| FR | 2339134 | A1 | * | 8/1977 | F23D 14/20 |
| FR | 2339134 | A1 | | 8/1977 | |
| JP | 02010022 | A | | 1/1990 | |
| JP | 09170725 | A | | 6/1997 | |
| WO | 0244618 | A1 | | 6/2002 | |
| WO | WO-0244618 | A1 | * | 6/2002 | F23D 14/02 |
| WO | WO-2008081271 | A2 | * | 7/2008 | F23D 14/58 |
| WO | 2009-112909 | A2 | | 9/2009 | |

OTHER PUBLICATIONS

India Intellectual Property First Examination Report of corresponding application No. 201917017656, dated Jun. 19, 2020, 6 pages (not prior art) (This citing is uploaded in 2 parts).

English Translations of Second Office Action and Search Report of corresponding China Patent Application No. 201780082946.9, dated Oct. 27, 2020, 6 pages (not prior art).

European Search Report of corresponding European patent application No. 17891259.8, dated Oct. 30, 2020, 7 pages (not prior art).

* cited by examiner

REDUCED RESONANCE BURNER

BACKGROUND

The present disclosure relates generally to a premix burner (combustion air and gas are mixed prior to entering the burner) for burning a combustible gas mixture.

Premix burners allowing for burning of a combustible gas mixture are known in the art. These premix burners, however, may include a burner surface or a burner support structure that allows an excessive noise level to be created when in operation. This effect can be further accentuated when the premix burner is contained within a small combustion chamber volume wherein all the energy causing the noise levels cannot dissipate within the volume. In such applications, the noise levels can be transmitted beyond the combustion chamber in varying oscillating wave forms that are audible and usually objectionable What is needed, therefore, is an improved burner construction which would eliminate or greatly reduce the noise level inherent in operating a premix burner.

BRIEF SUMMARY

Briefly, the present disclosure relates, in one embodiment, to a burner apparatus for burning a gas and air mixture. The burner apparatus may include a burner wall having a plurality of ridges and a plurality of grooves. Each groove may be defined between adjacent ridges. Each groove may also include a pair of slopes. Each slope may have an area of permeability having openings defined therein from which flames can project. Each ridge may define an area of reduced permeability relative to the areas of permeability of the slopes.

An alternative embodiment includes each area of reduced permeability of the ridges being less than half as permeable as the area of permeability of each slope.

Still another embodiment includes the area of reduced permeability of each ridge including no openings defined therein.

Yet another embodiment includes the openings defined in the slopes including a row of openings defined in each slope. The row of openings may be defined along a line extending in a direction generally parallel to a respective groove.

Another embodiment includes each pair of slopes including opposing rows of openings. Each opening on a given slope may be aligned with a corresponding opening on a respective opposing slope along a line extending in a direction generally perpendicular to the respective groove.

In a further embodiment, the openings defined in the slopes are configured to project the flames in a direction extending above an opposing slope and respective ridge.

A further still embodiment includes adjacent openings being less than about 10 cm from center to center.

Yet another embodiment includes the openings defined in each slope configured to project the flames such that a noise cancelling effect is achieved with destructive pressure wave interference created by the flames.

Still another embodiment includes the openings each including an opening diameter of less than about 1 cm.

An even further embodiment includes the burner wall having an outer surface. A flexible foraminous material may be disposed on the outer surface of the burner wall.

Another embodiment includes the foraminous material affixed to the burner wall such that the foraminous material closely follows the shape of the burner wall.

One embodiment includes the foraminous material spot welded to the burner wall.

A further embodiment includes the burner wall being generally cylindrical.

A further still embodiment includes the generally cylindrical burner wall having an end cap. The end cap may include ridges and grooves defined between adjacent ridges.

An even further embodiment includes the ridges and the grooves defined in the end cap forming concentric circles.

Yet another embodiment includes the generally cylindrical burner wall including a non-active end cap.

Still another embodiment includes the generally cylindrical burner including a base end and the non-active end cap including a curved end cap. The curved end cap may have a convex face facing toward the base end of the generally cylindrical burner.

The present disclosure also relates, in one embodiment, to a burner apparatus for burning a gas and air mixture. The burner apparatus may include a cylindrical burner wall. The cylindrical burner wall may have a plurality of ridges and a plurality of grooves. Each groove may be defined between adjacent ridges. A first group of openings may be defined in the cylindrical burner wall. Each opening of the first group of openings may be configured to allow a respective first flame to project therefrom, thereby producing first flame pressure waves. A second group of openings may also be defined in the cylindrical burner wall. Each opening of the second group of openings may be configured to allow a respective second flame to project therefrom, thereby producing second flame pressure waves. The first group of openings and the second group of openings may be oriented such that the first flame pressure waves and the second flame pressure waves destructively interfere with each other to reduce noise.

A further embodiment includes the cylindrical burner wall further having a cylinder length. The ridges and the grooves may alternate along the cylinder length.

Another embodiment includes the cylindrical burner wall further including a cylinder axis. Each of both the ridges and the grooves may extend in a direction that is perpendicular to the cylinder length and concentrically around the cylinder axis.

Still another embodiment includes the cylindrical burner wall having an end cap.

Yet another embodiment includes the end cap having a plurality of end cap ridges and a plurality of end cap grooves. Each end cap groove may be defined between adjacent end cap ridges. The end cap ridges and the end cap grooves may form concentric circles.

A further embodiment includes the end cap including a substantially non-active end cap having a concave outer face.

DETAILED DESCRIPTION

Figure 1:
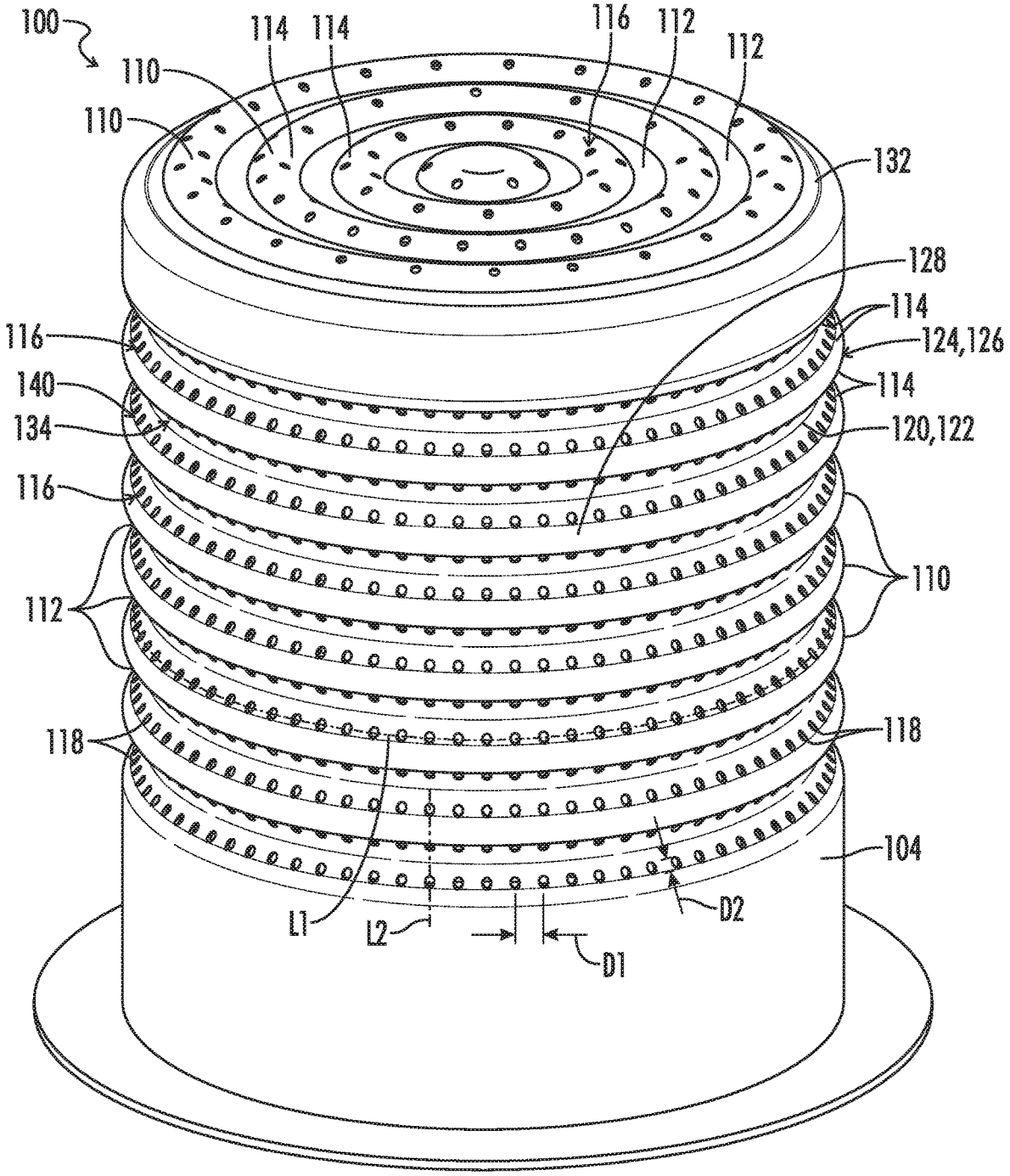
FIG. 1 is a perspective view of one embodiment of the burner apparatus.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

Sound is created by any cyclical pressure variation in an elastic medium, such as a gas, liquid, or solid. The audible frequency for most humans is in the range of 10 Hz to 16 KHz.

In a burner, sudden, rhythmic expansion and contraction of hot gases in an oscillating flame front can generate sound. The "flame front" is defined as the leading edge of the flame, which is the place where combustion stops and becomes hot exhaust product. In such an oscillating system, the flame front acts similarly to a speaker diaphragm. So, just as with a speaking diaphragm, the sound intensity increases as the area of the burner media or "diaphragm" increases. In a burner allowing for excessive resonant flame fronts, the sound waves can re-enforce each other should they get in synchronous motion, and create an unacceptably loud noise level.

In dealing with noises of any type, including the burner noise of the type just described, the designer can provide means to:

a. absorb or attenuate the energy of the wave form leaving the burner surface by using a muffling device,
b. disperse the energy wave forms at the surface of the burner into non-synchronous wave forms of varying energy pulsations by using tooling techniques and additional internal parts within the burner.
c. Eliminate the source of the noise by cancellation. This solution is particularly desirable as it eliminates the problem at the source.

There are a number of variables that can contribute to oscillatory flame noise. These variables include, but are not limited to, the type of fuel used, the burner firing rate, the burner size and shape, the firing intensity per unit area, the pressure drop across the burner, the flame shape and size, the fuel to air ratio, the fuel to air mixedness, and the aerodynamics of the combustion chamber.

The present disclosure illustrates and describes a manner of cancellation by eliminating or greatly reducing oscillatory burner noise.

Figure 2:
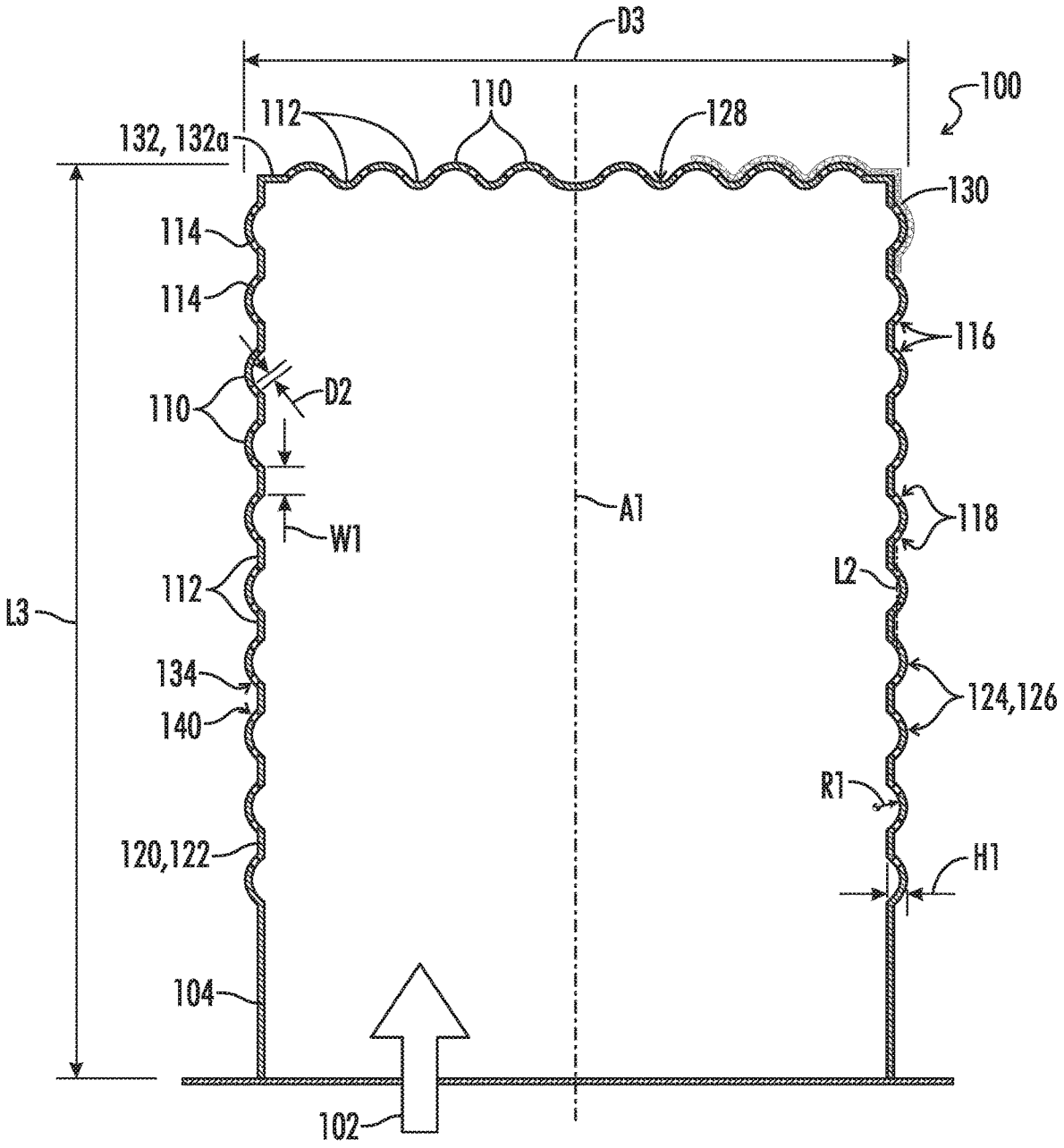
FIG. 2 is a side cross-sectional elevation view of the burner apparatus of FIG. 1.
Figure 3:
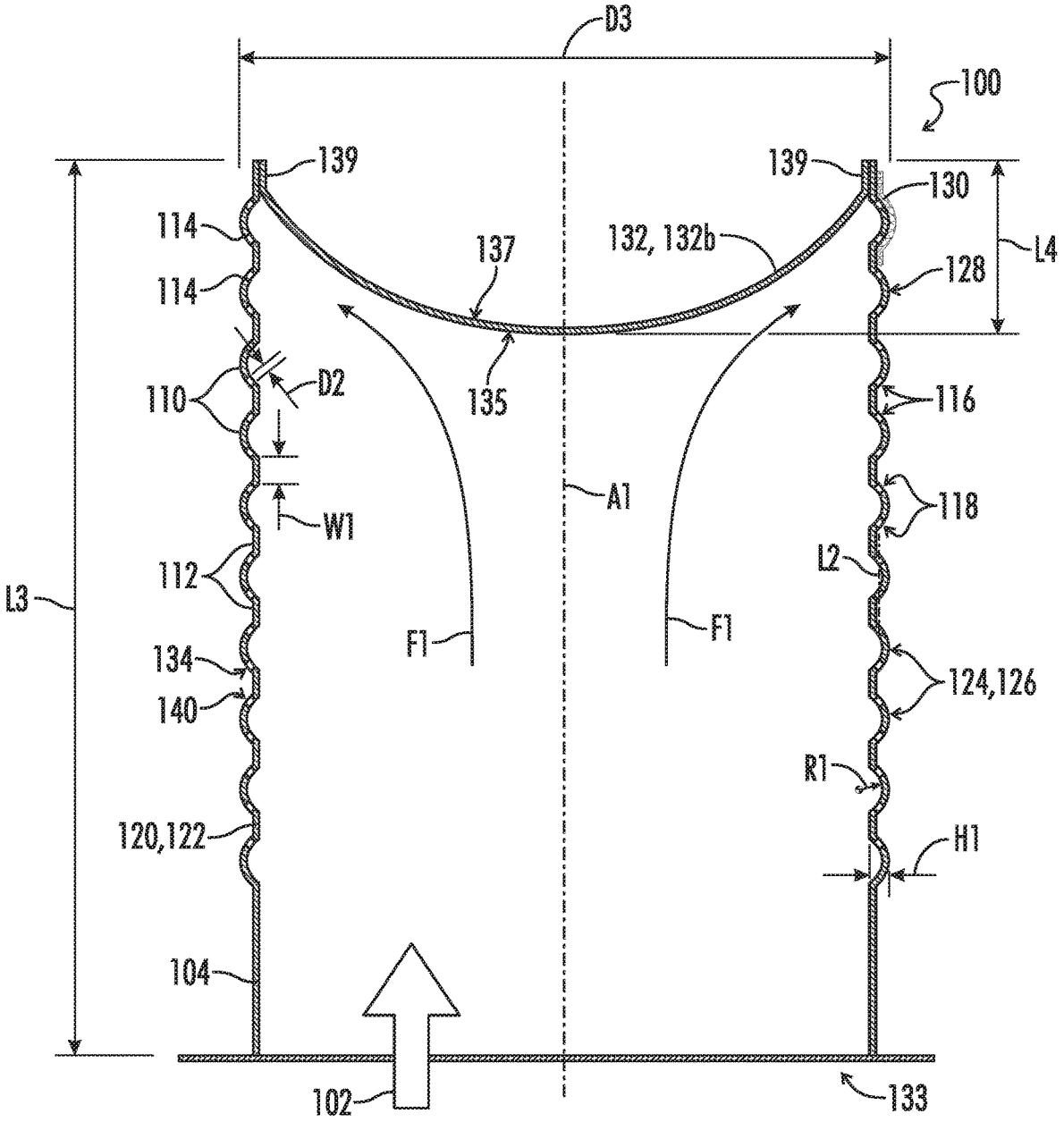
FIG. 3 is a side cross-sectional elevation view of another embodiment of the burner apparatus having a different end cap.
Figure 4:
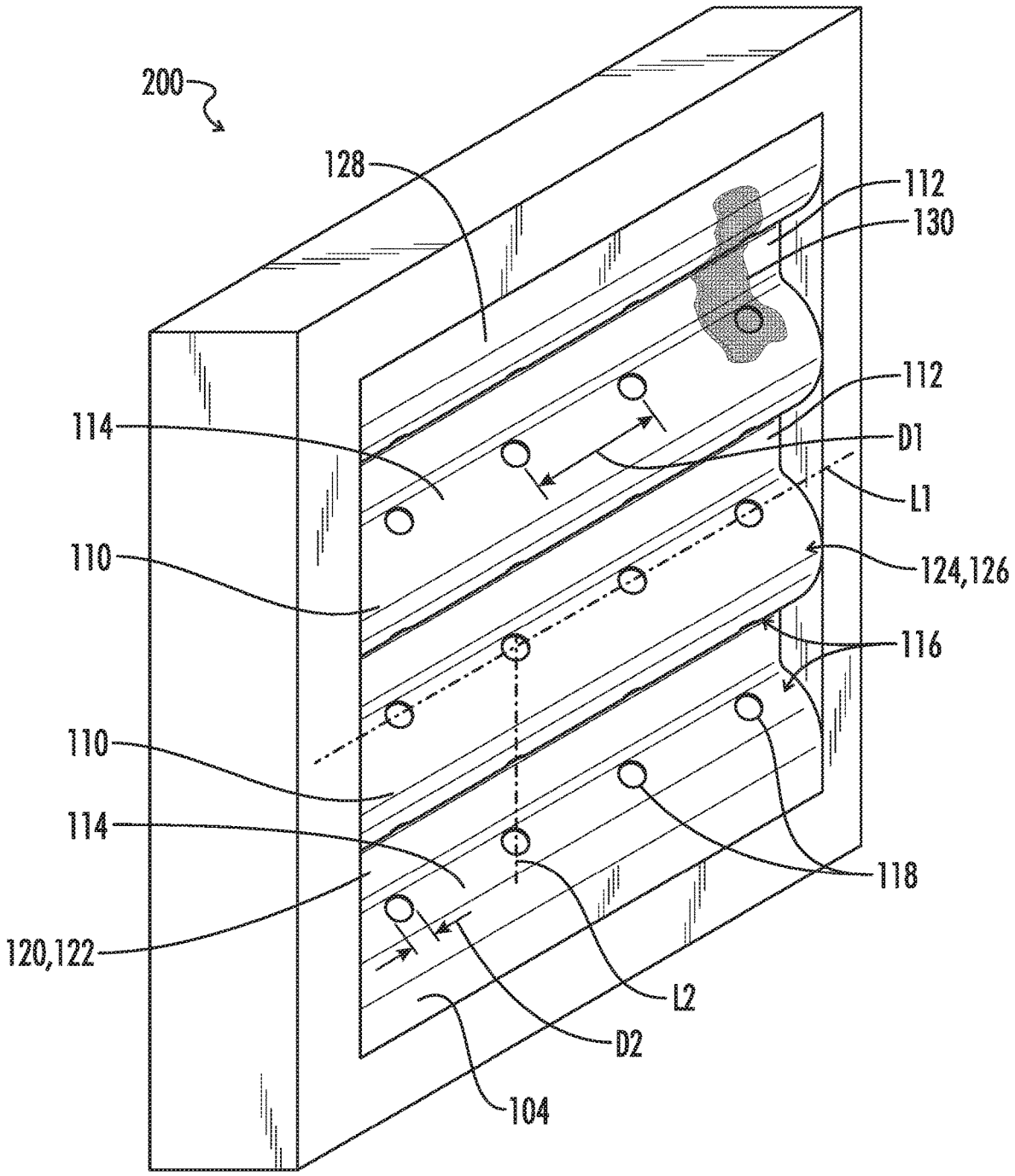
FIG. 4 is a perspective view of another embodiment of the burner apparatus.
Figure 5:
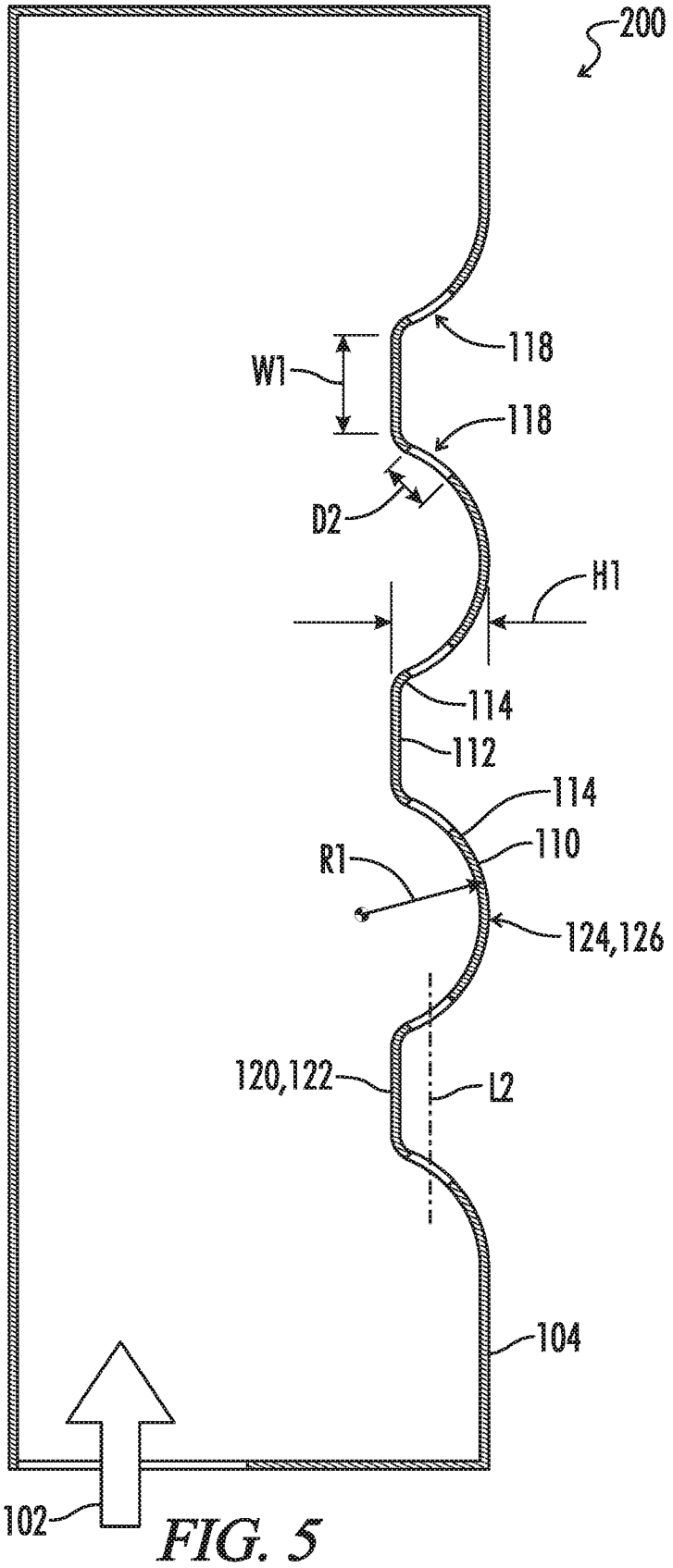
FIG. 5 is a side cross-sectional elevation view of the burner apparatus of FIG. 4.

As shown in the Figures, a burner apparatus 100, 200 may receive a mixture 102 of combustion air and gas which then exits the burner wall 104 to allow flames 106 to project therefrom. The burner apparatus 100, 200 may be of any appropriate shape. As shown in FIGS. 1-3, the burner apparatus 100 may be a generally cylindrical burner apparatus. In FIGS. 4 and 5, a generally planar burner apparatus 200 is shown. The materials of construction of the burner apparatus 100, 200 may be of any appropriate material that is either a rigid or a flexible heat resistant material. One suitable material for use as the burner wall 104 may be stainless steel that has been bent or formed into an appropriate shape, such as those shown in the Figures. Another suitable material may be a porous ceramic material formed in the requisite shape.

Referring now to FIGS. 1 and 4, a burner apparatus 100, 200 is shown. The burner apparatus 100, 200 may include a burner wall 104. In some embodiments, the burner wall may comprise a plurality of ridges 110 and a plurality of grooves 112. Each groove 112 may be defined between adjacent ridges 110. The grooves 112 may each include slopes 114 such that a pair of the slopes is included with each groove. Each slope 114 may include an area of permeability 116 having openings 118 defined therein. As can best be seen in FIG. 6, flames 106 may project from each of the openings 118.

Figure 6:
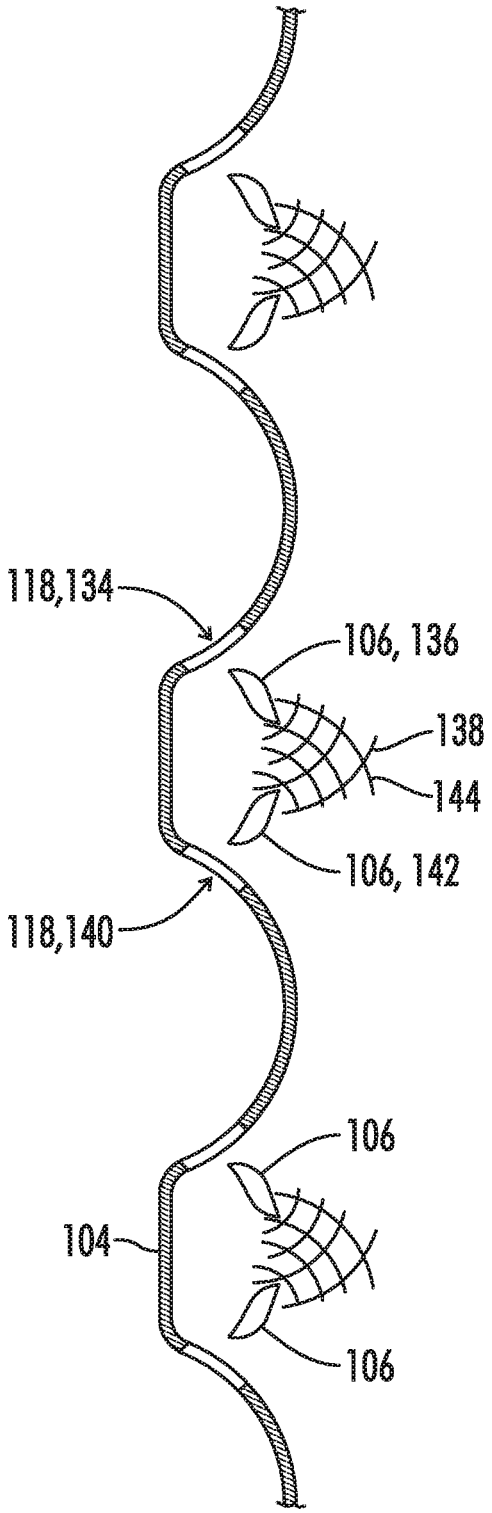
FIG. 6 is a detailed side cross-sectional elevation view of a burner wall of the burner apparatuses of both FIGS. 1, 3, and 4.

As shown in FIGS. 1 and 4, the openings 118 defined in the slopes 114 may include a row of openings defined in each slope along a line L1 extending in a direction generally parallel to a respective groove 112. In some embodiments, each pair of slopes 114 includes opposing rows of openings 118 such that each opening on a given slope is aligned with a corresponding opening on a respective opposing slope along a line L2 extending in a direction generally perpendicular to the respective groove 112. As shown in FIG. 6, some embodiments include the openings 118 defined in each slope 114 configured to project the flames 106 in a direction extending above an opposing slope and respective ridge 110. In many embodiments, the openings 118 defined in the slopes 114 are configured to project the flames 106 such that a noise cancelling effect is achieved with destructive pressure wave interference created by the flames. Returning to FIGS. 1 and 4, the openings 118 may have a center to center distance D1 of less than about 10 cm in some embodiments. This distance D1 may be measured along the line L1 in many embodiments. Other embodiments may include a center to center distance D1 of between about 0.5 cm and 1.5 cm. One embodiment may include a center to center distance D1 of 1 cm. The openings 118 in some embodiments may also include an opening diameter D2 of less than about 1 cm. Other embodiments may include an opening diameter D2 of between about 1 mm and 5 mm. One embodiment may include an opening diameter D2 of about 3 mm.

As can best be seen in FIGS. 2, 3, and 5, the grooves 112 may each include a groove floor 120. The groove floor 120 may include a substantially flat portion 122 defined between adjacent slopes 114. One embodiment may include the substantially flat portion 122 having a flat portion width W1 of up to about 0.5 inches. Another embodiment may include the substantially flat portion 122 having a flat portion width W1 of from about 0.15 inches to 0.35 inches. Still another embodiment may include the substantially flat portion 122 having a flat portion width W1 of about 0.25 inches. Other embodiments may include the groove floor 120 including a substantially curved floor.

Each of the plurality of ridges 110 may define an area of reduced permeability 124 relative to each area of permeability 116 of the slopes 114. Each area of reduced permeability 124 may be less than half as permeable as the area of permeability on a respective slope 114. In some embodiments, the area of reduced permeability 124 includes no openings 118 defined therein. In some embodiments, the areas of reduced permeability 124 may each functionally establish a barrier between respective adjacent grooves 112. In one embodiment, the barrier may be a complete barrier. Other embodiments may include only a partial barrier such that the area of reduced permeability 124 includes substantially fewer openings 118 defined therein compared to the area of permeability 116. The ridges 110 may be of any appropriate dimensions. One embodiment includes the ridges 110 having a maximum ridge height H1 extending outward from a plane coincident with the groove floor 120 of an adjacent groove 112. In some embodiments, the maximum ridge height H1 is up to about 1 inch. In other embodiments, the maximum ridge height H1 is between about 0.15 inches and about 0.35 inches. In one embodiment, the maximum ridge height H1 is about 0.25 inches. Each ridge 110 may include a curved ridge portion 126. In some embodiments, the curved ridge portion 126 may include a radius of curvature R1 of less than about 1 inch. In other embodiments, the radius of curvature R1 is between about 7 mm and about 10 mm.

As shown in FIGS. 2-4, the burner wall 104 includes an outer surface 128 that may optionally include a flexible foraminous material 130 disposed thereon. In many embodiments, the foraminous material 130 is affixed to the burner wall 104 such that the foraminous material closely follows the shape of the burner wall. The foraminous material 130 may also closely follow the shape of the outer surface 128. In some embodiments, the foraminous material 130 is spot welded to the outer surface 128 of the burner wall 104. There are several materials commercially available that comprise a woven or sintered fabric of metal fibers having a thickness of approximately ⅛". Other suitable flexible heat resistant materials include ceramic weaves and other alloy meshes. A fabric constructed of rock fiber could also be utilized. The foraminous material 130 as shown in FIGS. 2-4 only covers a small portion of the burner wall 104. This configuration is for illustration purposes, and the foraminous material 130 would preferably cover the majority of the outer surface 128. Some embodiments may include the foraminous material 130 covering all or substantially all of the outer surface 128.

With regard to FIGS. 1-3 showing embodiments of the burner apparatus 100 that are generally cylindrical, the burner wall 104 may be connected to an end cap 132. Stated another way, the burner wall 104 may include an end cap 132. As illustrated in FIGS. 1 and 2, some embodiments of the generally cylindrical burner apparatus 100 may include an end cap 132*a* having ridges 110, or end cap ridges, and grooves 112, or end cap grooves. The end cap 132*a* may further include a plurality of openings 118 in the areas of permeability 116 as described above. As mentioned above, the grooves 112 may be defined between adjacent ridges 110. The ridges 110 and grooves 112 defined in the end cap 132*a* may form concentric circles. The grooves 112 of the end cap 132*a* may be substantially the same as, or may be different from, the grooves of the burner wall 104.

As illustrated in FIG. 3, however, other embodiments of the generally cylindrical burner apparatus 100 may include an end cap 132*b* that is substantially non-active, or substantially devoid of openings 118. Some openings 118 may be defined in the substantially non-active end cap 132*b*. At least one embodiment of a non-active end cap 132*b* may have no openings 118 defined therein. In many embodiments, the generally cylindrical burner apparatus 100 may include a base end 133. The non-active end cap 132*b* may be a curved end cap having a convex face 135 and a concave face 137 opposite the convex face. In some embodiments, the convex face 135 may be facing toward the base end 133 of the generally cylindrical burner apparatus 100. Stated another way, the convex face 135 may face toward the base end 133 of the generally cylindrical burner apparatus 100. Stated yet another way, the substantially non-active end cap 132*b* may include a concave outer face 137. In embodiments including the non-active end cap 132*b* having the convex face 135 and the concave face 137, the end cap may be connected to the burner wall 104 in any appropriate manner. The non-active end cap 132*b*, in some embodiments, may further include a substantially flat portion 139 to facilitate attachment to the burner wall 104. Embodiments of the generally cylindrical burner apparatus 100 including a substantially non-active end cap 132*b* having the convex face 135 facing the base end 133 may allow for the gas and air mixture 102 to form at least some flow paths F1 that may be redirected by the end cap toward the burner wall 104. The redirection of these flow paths F1 may reduce the temperatures in and/or around the substantially non-active end cap 132*b*, thereby reducing stress and fatigue in the materials forming at least one of the end cap and the burner wall 104.

The generally cylindrical burner apparatus 100 may also further include a cylinder length L3 and a cylinder diameter D3. Some embodiments may include the cylinder length L3 being greater than the cylinder diameter D3. Other embodiments may include the cylinder diameter D3 being greater than the cylinder length L3. Still other embodiments may include the cylinder length L3 being equal to the cylinder diameter D3. The generally cylindrical burner apparatus 100 may further include a cylinder axis A1, and the ridges 110 and grooves 112 of the burner wall 104 may extend in a direction perpendicular to the cylinder length L3 and concentrically around the cylinder axis A1.

In embodiments including the non-active end cap 132*b* having convex and concave faces 135, 137, the end cap may extend a cap length L4 toward the base end 133 between about 0.1 times the cylinder diameter D3 and about 0.5 times the cylinder diameter. In some embodiments, the cap length L4 may be about 0.25 times the cylinder diameter D3.

Another embodiment of a cylindrical burner apparatus 100 may include a burner wall 104 having a cylindrical shape. The burner wall 104 may include a plurality of ridges 110 and grooves 112. Each groove 112 may be defined between adjacent ridges 110. A first group 134 of the openings 118 may be defined in the burner wall 104. As best shown in FIG. 6, each opening 118 of the first group 134 may be configured to allow a respective first flame 136 to project therefrom. First flame pressure waves 138 may thereby be produced. A second group 140 of the openings 118 may also be defined in the burner wall 104. Each opening 118 of the second group 140 may be configured to allow a respective second flame 142 to project therefrom. Second flame pressure waves 144 may thereby be produced. The first group 134 of the openings 118 and the second group 140 of the openings may be oriented such that the first flame pressure waves 138 and the second flame pressure waves 144 destructively interfere with each other to reduce noise.

As shown in FIGS. 1 and 4, the first group 134 may form a first row of the openings 118, and the second group 140 may form a second row of the openings. As can best be seen in FIG. 6, the groups 134, 140 of openings 118 may be oriented such that the general direction of the first flame pressure waves 138 and the general direction of the second flame pressure waves 144 intersect in a manner creating the destructive noise interference.

Returning to FIGS. 1-3, the burner wall 104 of the cylindrical burner apparatus 100 may include the ridges 110 and grooves 112 alternating along the cylinder length L3 of the burner apparatus. This alternating pattern may include ridges 110 and grooves 112 that are angled relative to the cylinder axis A1 and therefore twist around the cylinder axis such that the burner apparatus 100 resembles something similar to a barber shop pole in some embodiments. Other embodiments may include each of the ridges 110 and each of the grooves 112 extending in a direction perpendicular to the cylinder length L3 and concentrically around the cylinder axis A1 of the burner apparatus 100. Still other embodiments of the burner apparatus 100 may include the ridges 110 and the grooves 112 extending in a direction parallel to the cylinder axis A1. The end cap 132 may optionally be provided along with the burner wall 104. In some embodiments including an end cap 132*a*, ridges 110 and grooves 112 may also be provided on the end cap, also respectively called end cap ridges and end cap grooves. In many embodiments, the end cap ridges 110 and end cap grooves 112 may form concentric circles. These concentric circles may be concentric around the cylinder axis A1, for instance. In other embodiments including a substantially non-active end cap 132*b*, the end cap may include a concave outer face 137.

With reference to FIGS. 4 and 5, the burner apparatus 200 may also be generally planar. In such an embodiment, the burner apparatus 200 may include a burner wall 104 having horizontally, vertically, or diagonally extending parallel ridges 110 and grooves 112. Any appropriate orientation is also contemplated. These orientations and configurations include, but are not limited to, ridges 110 and grooves 112 that are circular, square, lines oriented in a series of rows, and the like. As with the generally cylindrical burner apparatus 100, the generally planar burner apparatus 200 may include any appropriate number of ridges 110 and grooves 112.

This written description uses examples to disclose the invention and also to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Although embodiments of the disclosure have been described using specific terms, such description is for illustrative purposes only. The words used are words of description rather than limitation. It is to be understood that changes and variations may be made by those of ordinary skill in the art without departing from the spirit or the scope of the present disclosure, which is set forth in the following claims. In addition, it should be understood that aspects of the various embodiments may be interchanged in whole or in part. While specific uses for the subject matter of the disclosure have been exemplified, other uses are contemplated. Therefore, the spirit and scope of the appended claims should not be limited to the description of the versions contained herein.

What is claimed is:

1. A burner apparatus for burning a pre-mixed gas and air mixture, the burner apparatus comprising:

a generally cylindrical burner wall extending continuously from a first end to a second end, the burner wall having a cylinder axis, the burner wall including:

a plurality of ridges, each ridge extending perpendicular to and concentrically around the cylinder axis;

a plurality of grooves, each groove defined between adjacent ridges and including a pair of slopes, each slope including an area of permeability having openings defined therein from which flames can project, wherein the ridges and grooves are coaxially disposed relative to the cylinder axis, the ridges and grooves extend all the way around a circumference of the generally cylindrical burner wall and the ridges and grooves alternate in an axial direction parallel to the cylinder axis;

wherein each of the plurality of ridges defines an area of reduced permeability relative to each area of permeability of the slopes;

wherein the openings defined in the slopes are configured to project the flames in a direction extending above an opposing slope and respective ridge, the flames from opposed slopes creating a circular band of flames adjacent each groove, the circular bands of flames being separated by circular bands of lesser or no flames adjacent each ridge;

wherein the openings defined in each slope are configured to project the flames such that a noise cancelling effect is achieved with destructive pressure wave interference created by the flames;

wherein the openings defined in the slopes include a row of openings defined in each slope along a line extending in a direction generally parallel to a respective groove; and wherein the row of openings in the slopes of each pair of opposing slopes are opposing rows of openings located at equal heights above a bottom of the groove between the slopes.

2. The burner apparatus of claim 1, wherein each area of reduced permeability of the ridges is less than half as permeable as the area of permeability of each slope.

3. The burner apparatus of claim 1, wherein the area of reduced permeability includes no openings defined therein.

4. The burner apparatus of claim 1, wherein adjacent openings are less than about 10 cm from center to center.

5. The burner apparatus of claim 1, wherein the openings each include an opening diameter of less than about 1 cm.

6. The burner apparatus of claim 1, wherein the burner wall includes an outer surface, and a flexible foraminous material is disposed on the outer surface of the burner wall.

7. The burner apparatus of claim 6, wherein the foraminous material is affixed to the burner wall such that the foraminous material closely follows the shape of the burner wall.

8. The burner apparatus of claim 7, wherein the foraminous material is spot welded to the burner wall.

9. The burner apparatus of claim 1, wherein the generally cylindrical burner wall includes an end cap, and the end cap includes ridges and grooves defined between adjacent ridges.

10. The burner apparatus of claim 9, wherein the ridges and the grooves defined in the end cap form concentric circles.

11. The burner apparatus of claim 1, wherein the generally cylindrical burner wall includes a non-active end cap.

12. The burner of claim 11, wherein:

the generally cylindrical burner includes a base end; and the non-active end cap comprises a curved end cap having a convex face facing toward the base end of the generally cylindrical burner.

13. A burner apparatus for burning a pre-mixed gas and air mixture, the burner apparatus comprising:

a cylindrical burner wall extending continuously from a first end to a second end and having a cylinder axis, the cylindrical burner wall including:

a plurality of ridges; and a plurality of grooves, each groove defined between adjacent ridges and including first and second opposed slopes;

wherein each of the ridges and the grooves extends in a direction perpendicular to the cylinder axis and concentrically all the way around the cylinder axis;

the first slope of each groove including a first group of openings defined in the cylindrical burner wall, each opening of the first group of openings configured to allow a respective first flame to project therefrom, thereby producing first flame pressure waves;

the second slope of each groove including a second group of openings defined in the cylindrical burner wall, each opening of the second group of openings configured to allow a respective second flame to project therefrom, thereby producing second flame pressure waves;

wherein the first group of openings and the second group of openings are oriented such that the first flame pressure waves and the second flame pressure waves destructively interfere with each other to reduce noise and such that the first and second flames create a circular band of flames adjacent each groove;

wherein each of the ridges defines an area of reduced permeability relative to each of the slopes; and wherein the circular bands of flames are separated by circular bands of lesser or no flames adjacent each ridge.

14. The burner apparatus of claim 13, wherein the cylindrical burner wall further includes a cylinder length, and the ridges and the grooves alternate along the cylinder length.

15. The burner apparatus of claim 13, wherein the cylindrical burner wall includes an end cap.

16. The burner apparatus of claim 15, wherein the end cap includes:

a plurality of end cap ridges;

a plurality of end cap grooves, each end cap groove defined between adjacent end cap ridges; and wherein the end cap ridges and the end cap grooves form concentric circles.

17. The burner apparatus of claim 15, wherein the end cap includes a substantially non-active end cap having a concave outer face.

* * * * *